US011841685B2

(12) United States Patent
Stranczl

(10) Patent No.: US 11,841,685 B2
(45) Date of Patent: Dec. 12, 2023

(54) HOROLOGICAL DISPLAY MECHANISM WITH ELASTIC HAND

(71) Applicant: Montres Breguet S.A., L'Abbaye (CH)

(72) Inventor: Marc Stranczl, Nyon (CH)

(73) Assignee: Montres Breguet S.A., L'Abbaye (CH)

( * ) Notice: Subject to any disclaimer, the term of this patent is extended or adjusted under 35 U.S.C. 154(b) by 415 days.

(21) Appl. No.: 17/168,504

(22) Filed: Feb. 5, 2021

(65) Prior Publication Data

US 2021/0373496 A1 Dec. 2, 2021

(30) Foreign Application Priority Data

May 27, 2020 (EP) ..... 20176720

(51) Int. Cl.

| | |
|---|---|
| ***G04B 13/02*** | (2006.01) |
| ***G04B 19/02*** | (2006.01) |
| ***G04B 13/00*** | (2006.01) |
| ***G04B 19/04*** | (2006.01) |
| ***G04B 45/00*** | (2006.01) |

(Continued)

(52) U.S. Cl.

CPC ..... *G04B 19/02* (2013.01); *G04B 9/005* (2013.01); *G04B 13/001* (2013.01); *G04B 13/007* (2013.01); *G04B 13/008* (2013.01); *G04B 13/021* (2013.01); *G04B 19/042* (2013.01); *G04B 19/048* (2013.01);

(Continued)

(58) Field of Classification Search

CPC .. G04B 19/082; G04B 19/042; G04B 13/021; G04B 9/005; G04B 45/0061; G04B 19/048; G04B 13/001; G04B 13/007; G04B 13/008; G04B 19/02

See application file for complete search history.

(56) References Cited

U.S. PATENT DOCUMENTS 9,075,392 B2 * 7/2015 Stranczl ..... G04B 45/0061
11,537,080 B2 * 12/2022 Bifrare ..... G04B 13/021

(Continued)

FOREIGN PATENT DOCUMENTS

CH 715 211 A2 1/2020
EP 2 863 274 A1 4/2015

(Continued)

OTHER PUBLICATIONS

European Search Report for 20 17 6720 dated Oct. 27, 2020.

*Primary Examiner* — Sean Kayes
(74) *Attorney, Agent, or Firm* — Sughrue Mion, PLLC

(57) ABSTRACT

A horological display mechanism (10) with elastic hand (1), including means for driving barrels (2; 4) coaxial at the ends of a flexible blade (3), including a differential mechanism with an input frame (180) including an input toothing (182), free to rotate and carrying an intermediate wheel (103) and a satellite (101) meshing with each other, this satellite (101) including an eccentric finger (1010) traveling the track (105) of a fixed cam (104), and returned against it by the elasticity of the elastic hand (1), the input frame (180) including a shaft (185) carrying, coaxially, a first cannon-pinion (1020) including the first barrel (2) and a second cannon-pinion (1040) including the second barrel (4), the toothing (1049) of one of which meshes with the toothing (1039) of the intermediate wheel (103), and the toothing (1029) of the other one of which meshes with the toothing (1019) of the satellite (101).

9 Claims, 5 Drawing Sheets

(51) Int. Cl.
*G04B 9/00* (2006.01)
*G04B 19/08* (2006.01)

(52) U.S. Cl.
CPC ..... *G04B 19/082* (2013.01); *G04B 45/0061* (2013.01); *G04B 13/02* (2013.01)

(56) References Cited

U.S. PATENT DOCUMENTS

| | | | | |
|---|---|---|---|---|
| 2012/0113763 | A1* | 5/2012 | Queval ..... | G04B 43/002 368/127 |
| 2014/0029389 | A1* | 1/2014 | Stranczl ..... | G04B 17/066 29/896.3 |
| 2015/0109891 | A1* | 4/2015 | Stranczl ..... | G04B 19/048 368/238 |
| 2019/0286058 | A1* | 9/2019 | Zaugg ..... | G04B 19/25353 |

FOREIGN PATENT DOCUMENTS

| | | | |
|---|---|---|---|
| EP | 3 159 751 | A1 | 4/2017 |
| EP | 3 605 244 | A1 | 2/2020 |

* cited by examiner

HOROLOGICAL DISPLAY MECHANISM WITH ELASTIC HAND

CROSS-REFERENCE TO RELATED APPLICATIONS

This application claims priority to European Patent Application No. 20176720.9 filed Mar. 27, 2020, the entire contents of which are incorporated herein by reference.

FIELD OF THE INVENTION

The invention relates to a variable-geometry horological display mechanism, including at least one elastic hand that includes a first drive barrel secured to a first end of a flexible blade, and a second drive barrel secured to another end of said flexible blade, and including a display index which, in a non-constrained free state of said elastic hand wherein both said first barrel and said second barrel are not subjected to any stress and are distant from each other, is distant from said first barrel and from said second barrel, the service position of said elastic hand being a stressed position where said first barrel and said second barrel are coaxial with each other around an output axis, said display mechanism including means for driving said first barrel about said output axis, and second means for driving said second barrel about said output axis, said first drive means and second drive means being arranged to deform said flexible blade, by varying the angular position of said second barrel with respect to the angular position of said first barrel around said output axis, and to vary the radial position of said display index with respect to said output axis.

The invention relates to a horological movement including at least one such display mechanism.

The invention relates to a watch including at least one such movement, and/or at least one such display mechanism.

The invention relates to the field of horological display mechanisms, and more particularly for timepieces with complications, the invention can be used both for static timepieces, such as pendulum clocks and other clocks and for watches, because of the small dimensions of the mechanism according to the invention.

BACKGROUND OF THE INVENTION

Good viewing of the display members on a timepiece is important for the user.

The dials of many timepieces are not circular, and it is advantageous to have available solutions making it possible to occupy the entire available surface, for an even better display.

The design of the variable-geometry display mechanism makes it possible to break a certain monotony of displays, and to make the display more vivid, with different appearances according to the time of day, or according to particular time periods. For example, among a very large number of other applications possible, an AM/PM display may be simply supplied by the form of a hand, which has a first appearance during the twelve hours of the morning, and a second appearance during the rest of the day; day/night displays, spherical lune displays, or others, can also be distinguished.

SUMMARY OF THE INVENTION

Elastic hands, and display mechanisms including such elastic hands, have been described in the documents EP2863274, EP3159751 and EP3605244, which disclose numerous variants.

The invention sets out to further simplify such a mechanism and to make it even more compact and economical to produce.

The invention also sets out to prevent any butting in this elastic-hand display mechanism, avoiding pushing a wheel, and favouring wheels that are mounted dragging.

To this end, the invention relates to a variable-geometry horological display mechanism according to claim 1.

The invention relates to a horological movement including at least one such display mechanism.

The invention relates to a watch including such a movement, and/or at least one such display mechanism.

BRIEF DESCRIPTION OF THE DRAWINGS

Other features and advantages of the invention will emerge from reading the following detailed description, with reference to the accompanying drawings, where.

DETAILED DESCRIPTION OF PREFERRED EMBODIMENTS

The application EP3605244, incorporated here by reference, relating to a variable-geometry horological display mechanism with elastic hand, discloses a first mechanism for actuation by means of wheels with shaped toothings. Such an embodiment allows the implementation of very innovative displays in horology, and is however expensive, and reserved for luxury items.

The same application describes yet another case of an actuation mechanism by means of a first differential on the train of the first barrel and a second differential on the train of the second barrel, and at least one cam constituting an input of such a differential. Consequently it is necessary to find and size a suitable (differential) planetary gear. Planetary gears have the advantage of achieving high transmission ratios in a compact manner. The input and output shafts are in line with each other. The possibilities of combining gears are very numerous. They make it possible, in particular, to produce interesting gearboxes. In the present case, it is a case of controlling one of the inputs of the differential, so as to generate an advance and respectively a retard of an equivalent specific value on each of the ends of the hand. And, when this value is zero, it is necessary to obtain a transmission ratio of 1 (the positive value signifies that the direction must also be identical).

The invention sets out to further simplify the mechanism and to make it even more compact and economical to produce. In particular when it is a case of installing the elastic hand on a small calibre, such as a ladies' watch, and in addition on the minutes hand. The main difficulty is related to the small torque available. It is then necessary to create a mechanism with the smallest possible energy consumption.

In redirecting the normal operation of a differential, the invention proposes to control the satellite. By installing a feeler-spindle in the satellite, and controlling the latter by a round cam, we obtain a gear ratio equal to one between the sun wheel and the frame carrying the satellite: the whole then behaves as a wheel.

Replacing the round cam of this example with a cam of suitable shape makes it possible henceforth to control the advance or retard that we wish to obtain on the barrel. It should be noted that, there also, the mechanism has no return spring to preserve the contact of the feeler-spindle on the cam, since it is the elastic hand that makes it possible fulfill this function.

The invention sets out to avoid any phenomenon of butting and avoiding the use of a pushed wheel, in particular a satellite, and favouring the use of dragging wheels.

Figure 8:
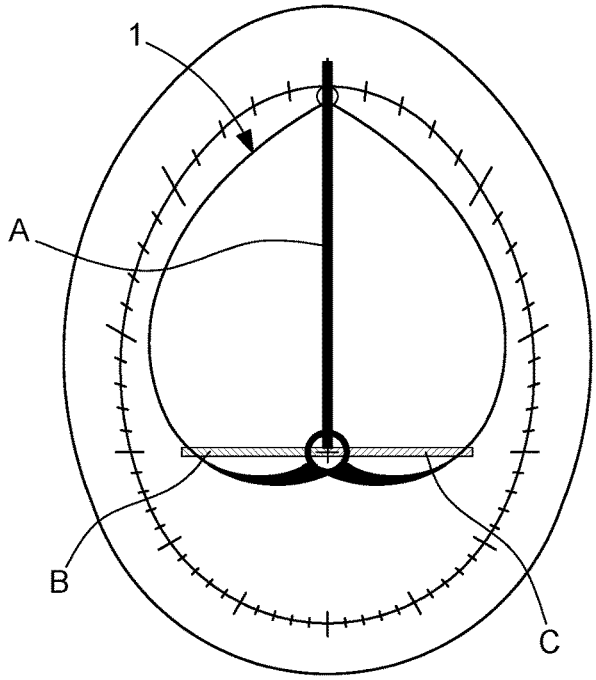
FIGS. 8 and 9 show, in a similar fashion to FIG. 4, the position of the differential plate and the positions of the arms of the elastic hand, respectively at noon in FIG. 8 and at four o'clock in FIG. 9.
Figure 9:
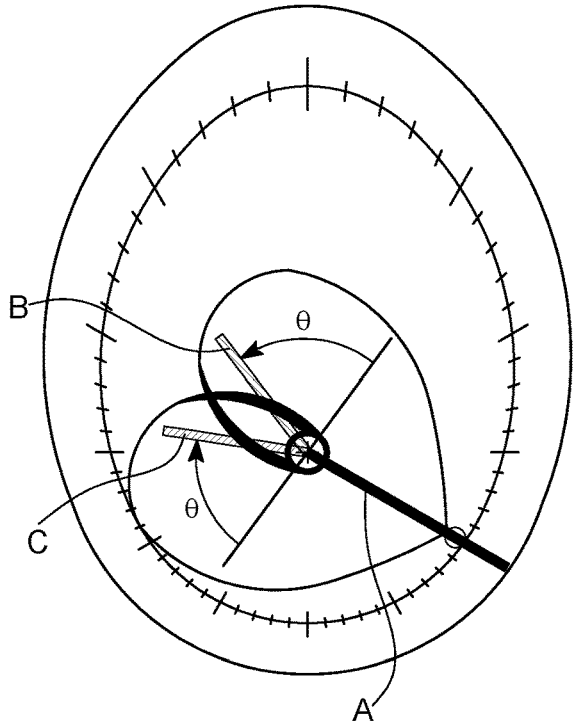

A particular actuation of the hand consists in taking a satellite-holder plate of a differential as a reference, so as to operate each hand barrel symmetrically. FIGS. 8 and 9 illustrate the angle of rotation to be imposed on the barrels 2 and 4 of the hand 1. In FIG. 8, the hand 1 indicates noon: the line A illustrates the position of the different plate, which in this non-limitative example turns at the rate of 1 turn per hour, and the lines B and C indicate the position of the arms of the hand 1. In FIG. 9, the hand 1 indicates four o'clock, the hand A of the differential plate points to the mark at four o'clock on the dial, and each arm B, C, with respect to the satellite carrier, has an advance and a symmetrical recoil of the same angle $\ominus$.

For this purpose, the invention relates more particularly to a variable-geometry horological display mechanism 10, including at least one elastic hand 1.

Such an elastic hand, and display mechanisms including such elastic hands, were described in the documents EP2863274, EP3159751, EP3605244 and EP3605243 incorporated here by reference, and which disclose numerous variants.

This elastic hand that includes a first drive barrel 2 secured to a first end of a flexible blade 3, and a second drive barrel 4 secured to another end of the flexible blade 3.

Figure 5:
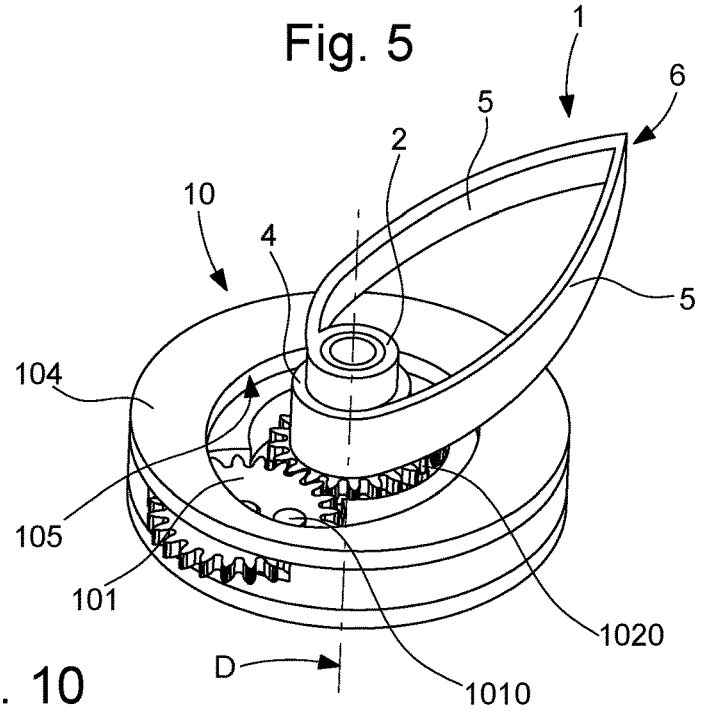
FIG. 5 shows, schematically, partially and in perspective, a display mechanism according to the invention, with the elastic hand on its barrels.
Figure 10:
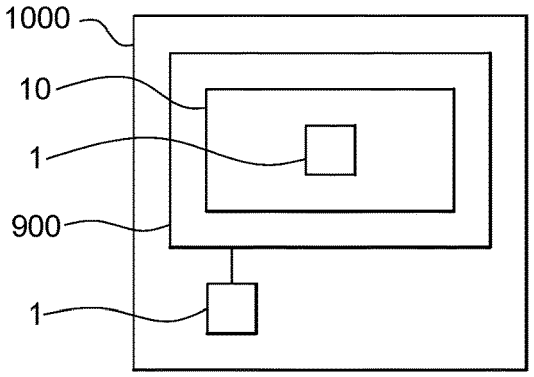
FIG. 10 is a block diagram of a timepiece including a movement and such a display mechanism.
Figure 6:
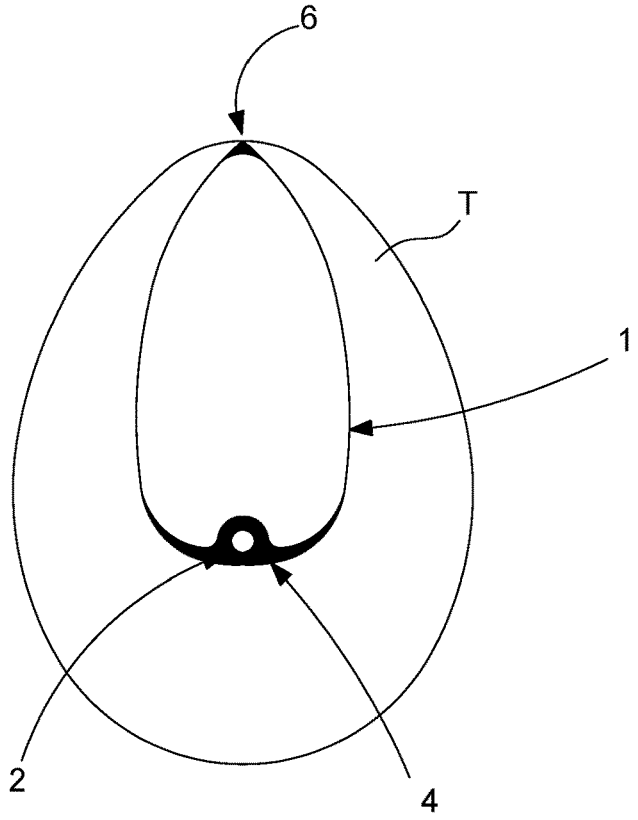
FIG. 6 illustrates, in a similar fashion to FIG. 4, the ovoid path associated with a tip of the elastic hand.
Figure 7:
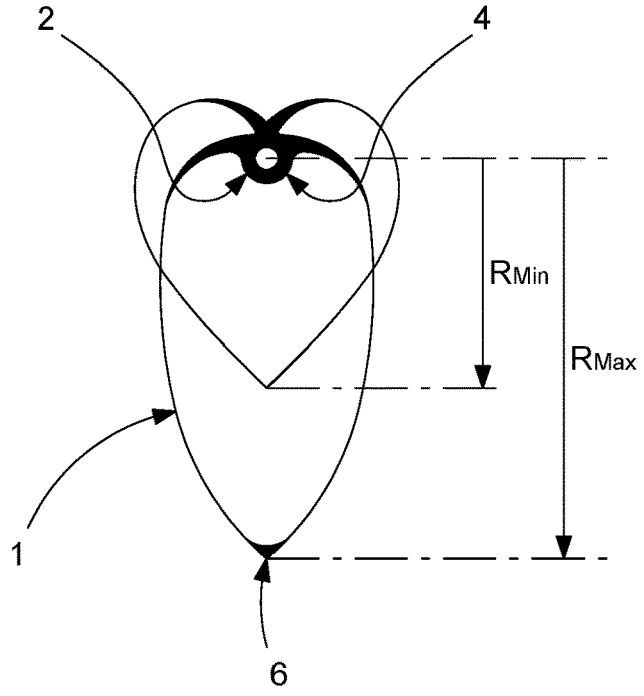
FIG. 7 illustrates, in a similar fashion to FIG. 4, the path associated with a tip of the elastic hand, which successively adopts almond and heart shapes.

This flexible blade 3 may be a continuous blade, or a blade including a succession of segments 5 joined two by two at the tips 6, as can be seen in FIGS. 5 and 6.

This flexible blade 3 includes a display index which, in a non-constrained free state of the elastic hand 1 in which both the first barrel 2 and the second barrel 4 are not subjected to any stress and are distant from each other, is distant from the first barrel 2 and from the second barrel 4, the service position of the elastic hand 1 being a constrained position where the first barrel 2 and the second barrel 4 are coaxial with each other around an output axis D. In particular in a variant including joined segments 5, the display index is advantageously, but not necessarily formed by a tip 6.

The display mechanism 10 includes first means for driving the first barrel 2 about the output axis D, and second means for driving the second barrel 4 about the output axis D.

Variants where the first barrel 2 and the second barrel 4 are not coaxial are not described here, they remain achievable for certain special displays, in particular displays that are not of revolution, such as retrograde or similar displays.

The first drive means and the second drive means are arranged to deform the flexible blade 3, by varying the angular position of the second barrel 4 with respect to the angular position of the first barrel 2 around the output axis D, and to vary the radial position of the display index with respect to the output axis D.

According to the invention, the display mechanism 10 includes a mechanism of the differential type including an input frame 180 mounted so as to be free to rotate about the output axis D. This input frame 180 includes a first pivot 183 and a second pivot 181 carrying respectively an intermediate wheel 103 and a single satellite 101 meshing with each other through their toothings 1039, 1019. This satellite 101 includes an eccentric finger 1010, which is arranged to travel a track 105 of a fixed cam 104, and which is returned against this track 105 by the elasticity of the elastic hand 1 itself. This input frame 180 includes input toothing 182 and/or a drive pinion, and a shaft 185 that carries, coaxial on the output axis D, a first cannon-pinion 1020 including the first barrel 2 and a second cannon-pinion 1040 including the second barrel 4, the toothing 1049 of one of which meshes with the toothing 1039 of the intermediate wheel 103, and the toothing 1029 of the other one of which meshes with the toothing 1019 of the satellite 101.

More particularly, and as can be seen in the particular and non-limitative variant illustrated, the track 105 is an internal track.

Figure 1:
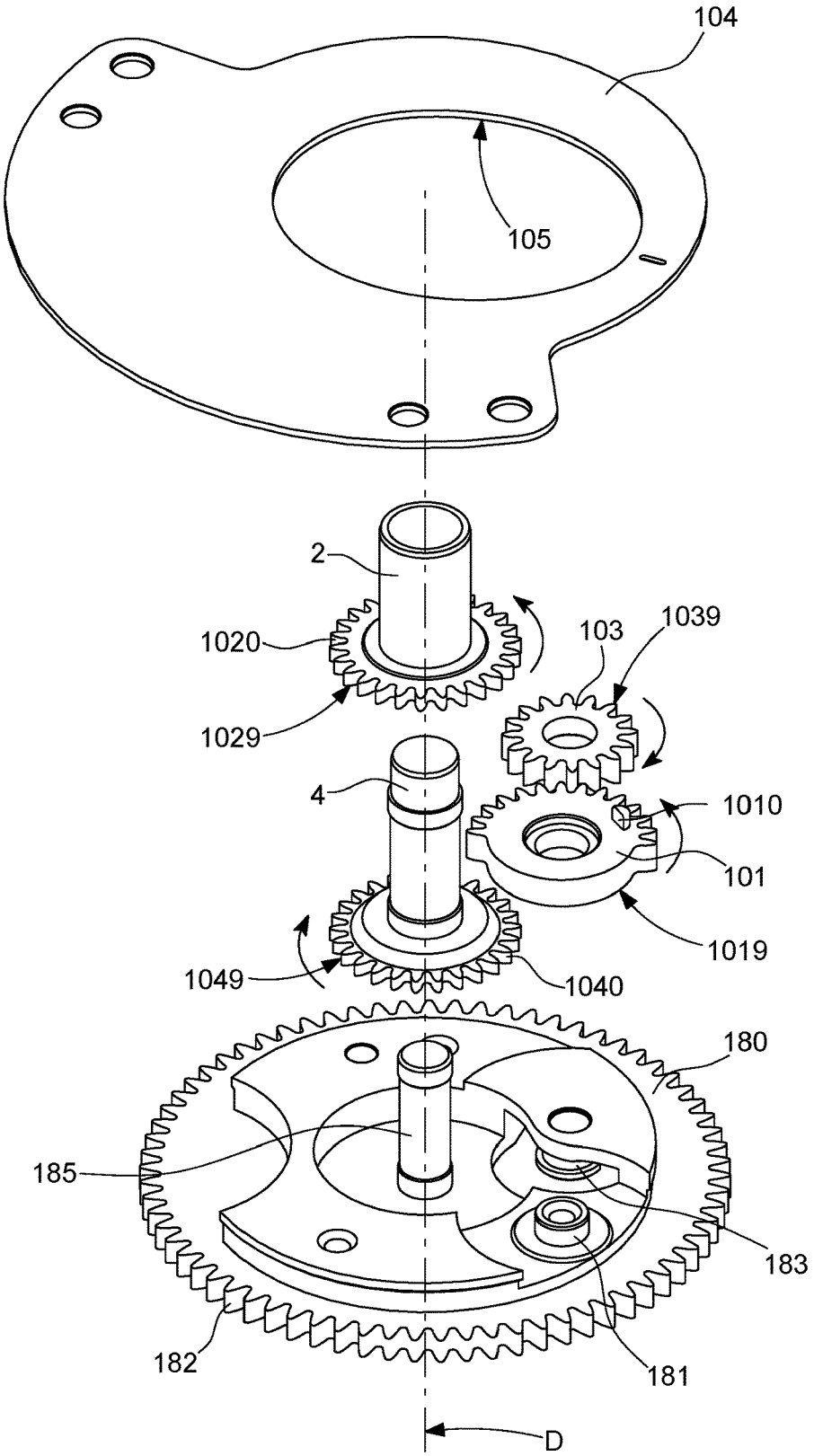
FIG. 1 shows, schematically, partially and in exploded perspective, a display mechanism according to the invention, limited to the barrels of the elastic hand, which is not shown; this mechanism includes a mechanism of the differential type carried by a satellite-holder frame, and the assembly thus shown constitutes an additional unit that can be adapted to an existing movement; the two barrels of the elastic hand are here coaxial around a cannon-pinion arranged so as to constitute an output of such a movement.
Figure 2:
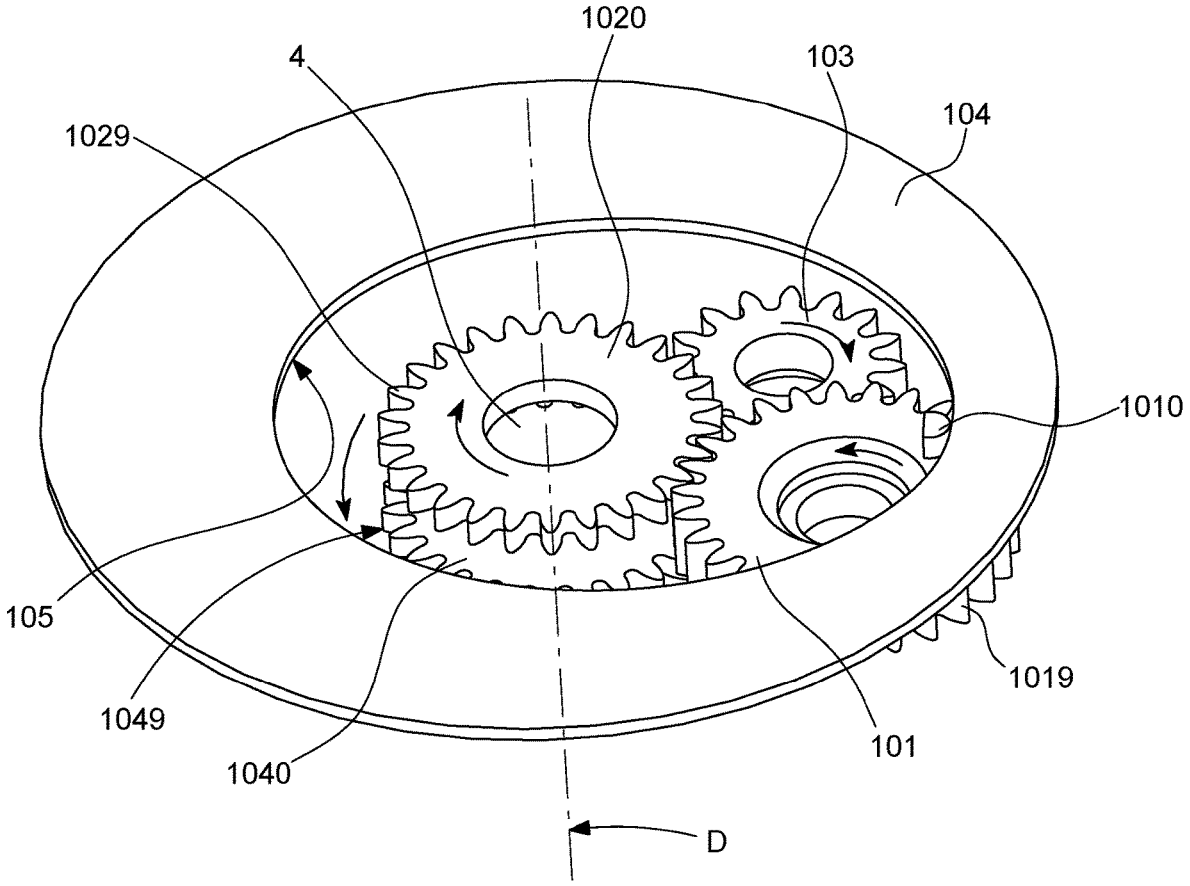
FIG. 2 shows, schematically, partially and in assembled perspective, the mechanism of FIG. 1, without the satellite-holder plate.
Figure 3:
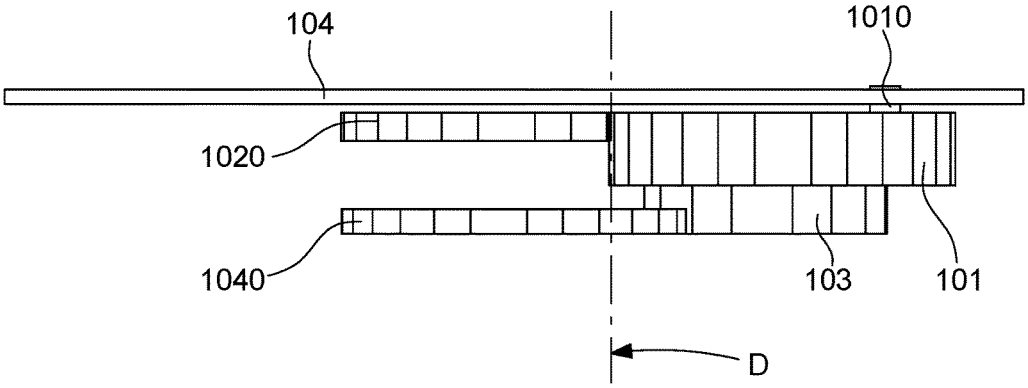
FIG. 3 shows, schematically, partially and in side view, the mechanism in FIG. 2.
Figure 4:
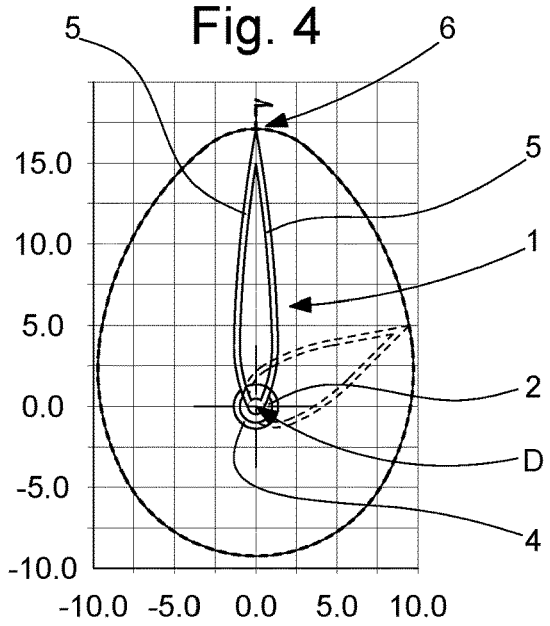
FIG. 4 shows, schematically and in plan view, an oval dial in front of which an elastic hand moves that includes such a display mechanism, said hand being shown in two different positions: in a solid line at twelve o'clock, and in a broken line at two o'clock.

Thus the invention simplifies the construction through the use of a single cam that feels the information of the angular delta $\Theta$ to be applied. This information is directly transmitted to a first cannon-pinion 1020. A second cannon-pinion 1040 receives this information via an intermediate wheel 103 that reverses the direction of the angular delta $\ominus$ to be applied, as can be seen in FIGS. 2 and 3: a single satellite 101, carried by the satellite-holder plate 180, feels, on a single cam track 105 that a flange 104 constituting the cam has, a single angular delta $\ominus$ to be applied to the two barrels 2 and 4 of the hand 1.

The satellite 101 applies the rotation directly to the first cannon-pinion 1020 carrying the first barrel 2. For the second cannon-pinion, the satellite 101 transmits the rotation via the intermediate wheel 103 to the second cannon-pinion 1040 carrying the second barrel 4, in order to reverse the direction of rotation.

The satellite 101 carries a finger 1010 that feels the cam track 105.

The satellite-holder plate 180 here includes a candle 185 for guiding the cannon-pinions 1040 and indirectly 1020, and an external toothing 182 driven by the horological movement, and pivots 181 and 183 guiding the satellite 101 and the intermediate wheel 103. The toothing 1019 of the satellite 101 meshes firstly with the toothing 1029 of the first cannon-pinion 1020, and secondly with the toothing 1039 of the intermediate wheel 103, which meshes with the toothing 1049 of the second cannon-pinion 1040.

FIG. 3 shows that this mechanism is extremely compact, with a slight thickness that enables it to be housed in a small watch case. The number of components is reduced, and none has any particular design complexity, and the cost of the whole is therefore moderate.

The invention also relates to a horological movement 900 including at least one such display mechanism 10.

The invention also relates to a watch 1000 including at least one such movement 900, and/or at least one such display mechanism 10.

In short, the invention makes it possible to generate the advance and/or retard on the two barrels of the elastic hand, making it possible to generate complex paths, the whole in a very simple and compact manner that is economical in terms of torque and therefore of great reliability.

This construction with a single satellite and a single cam does indeed have advantages. The additional disc is very simple. The single satellite is mounted dragging, and cannot butt in the clockwise direction. The energy consumption is low because of the reduced friction. The loss of amplitude at the resonator is very small. The mechanism includes few components and is compact, and is easy to assemble.

The invention claimed is:

1. A variable-geometry horological display mechanism (10), including at least one elastic hand (1) that includes a first drive barrel (2) secured to a first end of a flexible blade (3), and a second drive barrel (4) secured to another end of said flexible blade (3), and including a display index which, in a non-constrained free state of said elastic hand (1) in which both said first barrel (2) and said second barrel (4) are not subjected to any stress and are distant from each other, is distant from said first barrel (2) and from said second barrel (4), the service position of said elastic hand (1) being a constrained position where said first barrel (2) and said second barrel (4) are coaxial with each other around an output axis (D), said display mechanism (10) including first means for driving said first barrel (2) about said output axis (D), and second means for driving said second barrel (4) about said output axis (D), said first drive means and second drive means being arranged to deform said flexible blade (3), and varying the angular position of said second barrel (4) with respect to the angular position of said first barrel (2) around said output axis (D), and to vary the radial position of said display index with respect to said output axis (D), wherein said display mechanism includes a mechanism of the differential type including an input frame (180) mounted so as to be free to rotate about said output axis (D), said input frame (180) includes a first pivot (183) and a second pivot (181) carrying respectively an intermediate wheel (103) and a satellite (101) meshing with each other through their toothings (1039; 1019), said satellite (101) including an eccentric finger (1010) that is arranged to travel a track (105) of a fixed cam (104), and which is returned against said track (105) by the elasticity of said elastic hand (1), said input frame (180) including an input toothing (182), and a shaft (185) that carries, coaxial along said output axis (D), a first cannon-pinion (1020) including said first barrel (2) and a second cannon-pinion (1040) including said second barrel (4), the toothing (1049) of one of which meshes with the toothing (1039) of said intermediate wheel (103), and the toothing (1029) of the other one of which meshes with the toothing (1019) of said satellite (101).

2. The display mechanism (10) according to claim 1, wherein said track (105) is an internal track.

3. The display mechanism (10) according to claim 1, wherein said cam (104) is the only one.

4. The display mechanism (10) according to claim 1, wherein said cam (104) is arranged to feel the information of an angular delta $\ominus$ to be applied, said information being directly transmitted to a first cannon-pinion (1020) and indirectly to a second cannon-pinion (1040) via an intermediate wheel (103) for reversing the direction of said angular delta $\ominus$ to be applied to said first barrel (2) and to said second barrel (4) of said elastic hand (1).

5. The display mechanism (10) according to claim 4, wherein said input frame (180) forming a satellite-holder plate includes a candle (185) for guiding said first cannon-pinion (1020) and said second cannon-pinion (1040), and an external toothing (182) or a pinion for driving thereof by a horological movement, and pivots (181; 183) for guiding said satellite (101) and said intermediate wheel (103), said satellite (101) including a satellite toothing (1019) that meshes firstly with a first toothing (1029) of said first cannon-pinion (1020) and secondly with an intermediate-wheel toothing (1039) of said intermediate wheel (103), which meshes with a second toothing (1049) of said second cannon-pinion (1040).

6. The display mechanism (10) according to claim 1, wherein said satellite (101) is the only one, carried by said input frame (180) forming a satellite-holder plate, and is arranged to feel, on a single said cam track (105), a single said angular delta $\ominus$.

7. Horological movement (900) including at least one display mechanism (10) according to claim 1, and arranged to drive said input frame (180).

8. A watch (1000) including at least one movement (900) according to claim 7.

9. A watch (1000) including at least one display mechanism (10) according to claim 1.

* * * * *